United States Patent [19]

Spring

[11] 4,431,190

[45] Feb. 14, 1984

[54] RANDOM OUTPUT DEVICE FOR GAME

[75] Inventor: Gorden W. Spring, Long Beach, Calif.

[73] Assignee: Tomy Corporation, Carson, Calif.

[21] Appl. No.: 407,739

[22] Filed: Aug. 13, 1982

[51] Int. Cl.[3] ..... A63F 9/00

[52] U.S. Cl. ..... 273/138 R; 46/204

[58] Field of Search ..... 273/138 R, 138 A, 1 R; 46/204

[56] References Cited

U.S. PATENT DOCUMENTS

| | | | |
|---|---|---|---|
| 1,980,844 | 11/1934 | Ball | 273/138 R UX |
| 2,674,989 | 4/1954 | Morsch | 46/204 X |
| 3,312,012 | 4/1967 | Strauss | 46/204 X |
| 3,411,786 | 11/1968 | Cooper | 273/138 R |
| 3,469,838 | 9/1969 | Thum et al. | 273/1 R |

*Primary Examiner*—Paul E. Shapiro

*Attorney, Agent, or Firm*—K. H. Boswell; Edward D. O'Brian

[57] ABSTRACT

A device for producing a random output for use in conjunction primarily with games includes a housing having a first and second wheel each independently mounted within the housing and capable of rotating with respect to the housing. A portion of each of the wheels is exposed outside of the housing such that it can be contacted against a surface and each of the wheels independently rotated with respect to the housing as the housing is moved with respect to the surface. An indicating member is mounted on the housing and is capable of moving between an indicating and a non-indicating position. A first and second control component links the indicating member to the first and second wheel respectively. Depending upon the location of the first and second wheels, the first and second control components both have a release position and a lock position. When both of the control components are in the release position, the indicating member will move to the indicating position. However, when either one or both of the first or the second control members are in the lock position, the indicating member will be maintained in the non-indicating position. Movement of the housing across a surface rotating the wheels will cause the indicating member to move from the non-indicating to the indicating position in a random manner depending upon random rotation of one of the wheels with respect to the other.

10 Claims, 5 Drawing Figures

RANDOM OUTPUT DEVICE FOR GAME

BACKGROUND OF THE INVENTION

This invention is directed to a device capable of producing a random output and usable in connection with games and the like. The random output of the device is related to a rotary movement of wheels located in a housing which in turn are coupled to an indicating member via a control device.

Many interesting and stimulating games include as part of the game a mechanism for producing a random output. Presently, the most universal device for producing such random output is a common set of dice. Thus, many games depend on each of the players in turn rolling one or more dice and basing their moves on the particular face of the dice which becomes located in an upright position.

Other than dice, other randomizing devices are also in existence. These include spinning pointers, decks of cards and other similar devices which have a finite number of moves, plays or positions incorporated therein. Because these devices do have a finite limitation, i.e., each cubic dice only has six faces and thus can only represent six particular states, such randomizing devices do limit the manner of play of the game they are used with.

With the exception of a spinning pointer, the above noted randomizing devices do not incorporate a time suspense in their use. If a player of a game throws a dice or set of dice or the like, he immediately knows the outcome thereof. Similarly, if he draws a card or other written instructions, he also immediately knows the outcome thereof. A spinning pointer, of course, will take time for the pointer to stop rotation once it has started to spin and thus does add a suspenseful element to the game in which it is used. However, the spinning pointer, usually because of its frail construction dicated by the economics of producing a low priced game, will only spin for a very short period of time and, thus, any element of suspense is usually of a very short duration.

BRIEF DESCRIPTION OF THE INVENTION

In view of the above, it is considered that there exists a need for a randomizing device to be utilized primarily with games and the like which is capable of producing a random output but which simultaneously is capable of inducing an element of suspense as to where and when the random output will be produced. It is therefore a broad object of this invention to fulfill this need. It is a further object of this invention to provide a randomizing device which is capable of being used with a variety of different games, more specifically, board games which include a playing surface. It is a further object to provide a randomizing device which because of its simplificity of engineering is easily and economically manufactured and, thus, can be incorporated into a variety of economically accessible games for the consumer. In conjunction with the object of the preceding sentence, however, it is a further object to provide a device which even though it employs simplicity of construction is still capable of producing a random output suitable for use with a variety of different game formats.

These and other objects as will become evident from the remainder of this specification are achieved in a device for producing a random output which comprises a housing, a first and second rotary member each rotatably mounted on said housing and each capable of rotating with respect to said housing independent of the other, a continuously variable portion of each of said first and said second rotary members located in positions wherein said portions are capable of being contacted against a surface and said contact between said portions and said surface independently rotating both of said first and said second rotary member with respect to said housing in response to movement of said housing with respect to said surface, an indicating means movably mounted on said housing, said indicating means capable of alternately being located in an indicating position and a non-indicating position, said indicating means including a moving means capable of moving said indicating means from said non-indicating position to said indicating position, a first control means, a portion of said first control means associated with said first rotary member and the remaining portion of said first control means associated with said indicating means, a second control means, a portion of said second control means associated with said second rotary member and the remaining portion of said second control means associated with said indicating means, each of said first and said second control means capable of being located in either a release position or a locked position, each of said first and said second control means alternately moving between said release position and said locked position in response to rotation of said first and said second rotary members, respectively, on said housing, said indicating means moving under the influence of said moving means from said non-indicating position to said indicating position when both of said first and said second control means are in said release position, said indicating means incapable of moving under the influence of said moving means from said non-indicating position to said indicating position when at least one of said first or said second control means is in said locked position.

In the preferred embodiment of the invention, the first and second rotary members will each comprise a wheel rotatably mounted on the housing with the outside periphery of each of the wheels comprising the continuously variable portion thereof. Further, preferredly, one of the wheels will have a radius greater than the other of the wheels such that their rotations will differ as they are moved along a linear line on a surface.

Preferredly, each of the wheels will include a circumferentially extending axially projecting skirt means located thereon. The portion of the first control means associated with the first rotary member will comprise a first release means located on the first wheel skirt and the portion of the second control means associated with the second rotary member will comprise a second release means located on the second wheel skirt. The indicating means would include a first release arm means and a second release arm means with the first release arm means comprising that portion of the first control means associated with the indicating means and the second release arm means comprising that portion of the second control means associated with the indicating means. The first release arm means would be operatively associated with the first wheel skirt means and the second release arm means would be operatively associated with the second wheel skirt means.

In the preferred embodiment, the indicating means would comprise an indicating member pivotally mounted on the housing and having the first and second release arm means attached thereto and movable with the indicating member. The moving means would comprise a biasing means operatively associated with the indicating member and biasing the indicating member towards the indicating position.

In the preferred embodiment, the first and second release arm means would each comprise a spring arm having ends one of which would be attached to the indicating member and the second end including a latching means located thereon. The latching means on the first spring arm is operatively associated with the first wheel skirt means and the latching means on the second spring arm is operatively associated with the second wheel skirt means. The indicating member would be held in the non-indicating position when one or both of the latching means located on the first or second spring arms was engaged with the respective first or second wheel skirt means and the indicating member would be allowed to move under the bias of the biasing means from the non-indicating to the indicating position when both of the latching means on the first and second spring arms unlatched with the respective skirt means.

Preferredly, each of the first and second release means would comprise an opening located in the respective first or second skirt means and the first and second latch means would comprise a detent means located on the end of the respective first or second spring arms. When the openings in the respective skirts align with the detent means on the respective spring arms, interaction between the detent means and the skirt means would be broken by the presence of the openings allowing movement of the detent means away from the skirt means which, in turn, would allow movement of the indicating member from the non-indicating position to the indicating position.

BRIEF DESCRIPTION OF THE DRAWINGS

The invention as herein described in this specification will be further understood when taken in conjunction with the drawings attached hereto wherein.

DETAILED DESCRIPTION OF THE INVENTION

Figure 1:
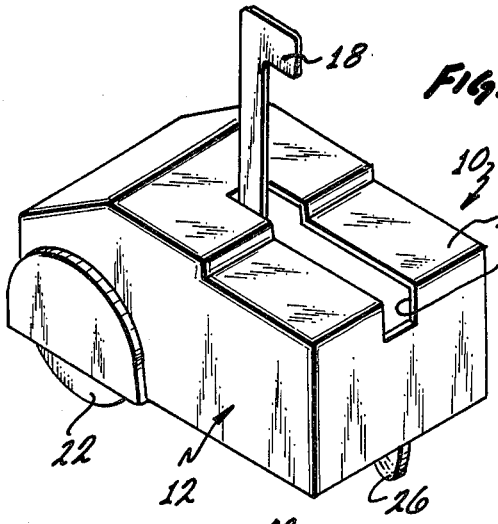
FIG. 1 is an oblique view showing the preferred embodiment of the invention.
Figure 2:
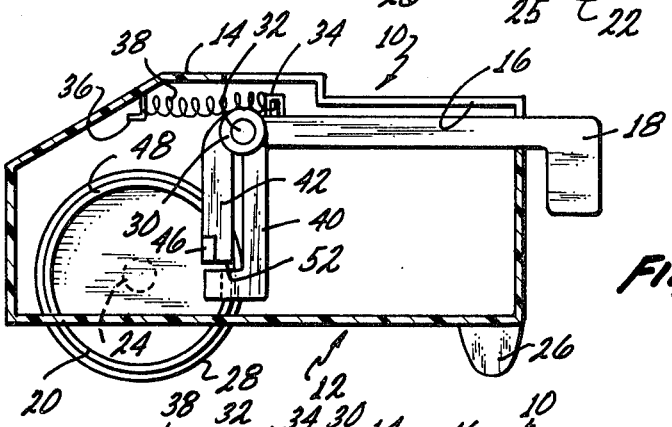
FIG. 2 is a side elevational view in section of the embodiment of FIG. 1.
Figure 3:
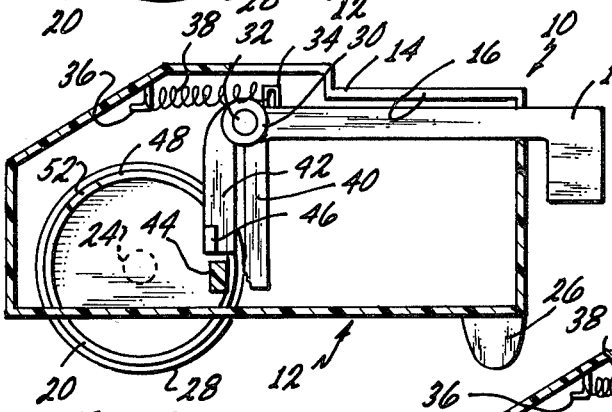
FIG. 3 is a side elevational view in section similar to FIG. 2 with the exception that one of the components of the invention has been rotated with respect to the other components.
Figure 4:
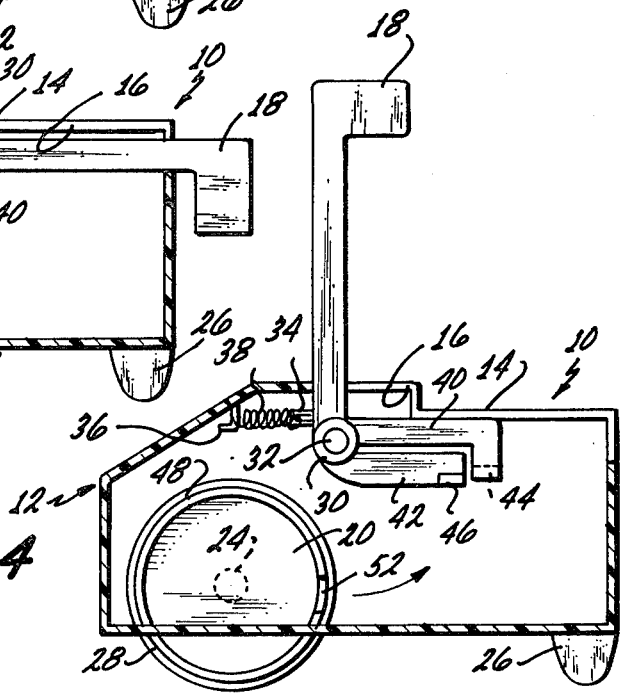
FIG. 4 is a side elevational view in section with a further component of the invention being moved in relationship to that shown in FIGS. 2 and 3.

In the preferred embodiment of the invention shown in the figures, the small vehicle-like device 10 has an exterior housing 12 formed as a shell. Extending longitudinally down the length of the housing 12 on its upper surface 14 is an elongated slot 16. The elongated slot 16 serves to allow an indicating member 18 to move between a non-indicating position as is represented in FIGS. 2 and 3, and an indicating position as is represented in FIGS. 1 and 4.

A first wheel 20 and a second wheel 22, of slightly different diameters, are independently mounted on the inside of the housing 12. The bottom of the housing is open allowing a portion of each of the wheels 20 and 22 to extend down below the housing 12. Each of the wheels 20 and 22 are independently located on axles 24 and 25, respectively, which are integrally formed as part of the wheels.

The axles 24 and 25 fit into bearing surfaces (not shown or numbered) which are formed on the inside of the housing 12. Axle 25 extends on both sides of wheel 22 with one side of axle 25 fitting into the above noted bearing surface and the other side extending across the inside of the housing 12 and contacting, but not connecting to, wheel 20. This holds both wheels 20 and 22 in position in the housing 12. Both wheel 20 and wheel 22 spin freely with respect to each other and to the housing 12, and this, in conjunction with their slightly different diameters, results in both their speed and direction of rotation being independent of the speed and direction of rotation of the other of the wheels. A small tab 26, formed as a downward extension of the housing 12, projects from the front end of housing 12 and is essentially supported by three points upon a surface and will essentially remain in a level configuration on such a surface.

In order to assist in gripping the surface, each of the wheels 20 and 22 can be provided with a rubber ring, collectively identified by the numeral 28, on its outside periphery. The wheels 20 and 22 are preferredly formed of a moldable plastic material as is the housing 12 and the indicating member 18. This material is generally hard, and thus it is conceivable that it would simply slide against a hard surface and not rotate. By including the rubber rings 28 on the wheels 20 and 22, it is assured that any movement of the housing 12 over the surface will be communicated as rotation of the wheels 20 and 22.

Figure 5:
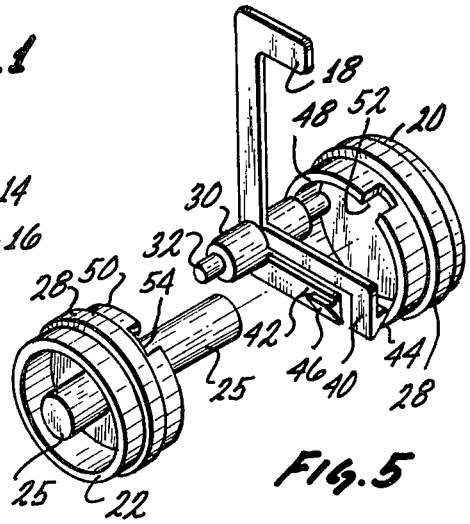
FIG. 5 is an exploded view of certain other components of the invention.

The indicating member 18 is formed as a portion of a more complex member best seen in FIG. 5. Attached to a central section 30 is the indicating member 18. The central section 30 includes axle segments, collectively identified by the numeral 32, projecting from both of its ends. The axles 32 fit into appropriate bearing surfaces (not shown or numbered) located in the inside of the housing 12. Likewise, axles 24 are connected to the interior of the housing 12. The central section 30 is free to rotate about the axles 32 with little or no friction. A tab 34 is located on the indicating member 18 next to where the indicating member 18 mates with the central section 30. A second tab 36 is formed on the interior of the housing 12. A spring 38 extends between the tabs 34 and 36 biasing the indicating member 18 upwardly to the indicating position as seen in FIGS. 1 and 4. When the indicating member 18 is moved to the non-indicating position as seen in FIGS. 2 and 3, the spring 38 is stretched, creating the bias to move the indicating member 18 to the indicating position.

Also formed as a part of and extending out of central section 30 are first and second spring arms 40 and 42. As is evident from viewing the figures, the spring arms 40 and 42 are located about a 90° angle to the indicating member 18. The end of the spring arms 40 and 42, opposite the attachment point to the central section 30, each contain a detent tooth 44 and 46. The spring arms 40 and 42 are capable of flexing slightly away from wheels 20 and 22, and as a result of this, the detent teeth 44 and 46 are moved away from the wheels 20 and 22, respectively.

Each of the wheels 20 and 22 include a circumferentially extending axially projecting skirt 48 and 50, respectively. Each of the skirts 48 and 50 essentially project towards each other. An opening 52 is located in skirt 48 and a coresponding opening is located in skirt 50.

The wheels 20 and 22 are located with respect to the spring arms 40 and 42 such that when the indicating member 18 is in the non-indicating position, the detent teeth 44 and 46 can be located within the inside of the respective skirts 48 and 50. The openings 52 and 54, however, are so placed in the skirts 48 and 50 that when the appropriate wheel 20 or 22 is rotated such that the appropriate opening 52 or 54 is located directly adjacent to the appropriate detent tooth 44 or 46, the detent tooth 44 or 46 is no longer held in position by the skirt 48 or 50, but is allowed to freely pass through the openings 52 and 54. This allows release of the detent tooth 44 or 46 from its position within the interior of skirt 48 or 50.

As noted above, each of the spring arms 40 and 42 can flex slightly. When the indicating member 18 is moved manually from its indicating position to its non-indicating position, the detent teeth 44 and 46 are abutted up against the outside of the skirts 48 and 50, respectively. Each of the detent teeth 44 and 46 have a slight bevel, such that in bringing down the indicating member 18 to bring the spring arms 40 and 42 toward the wheels 20 and 22, the detent teeth 44 and 46 come in contact with the outside of the skirts 48 and 50. The beveling on each of these detent teeth 44 and 46 causes an inwardly directed component of force to be transmitted from the skirts 48 and 50 via the detent teeth 44 and 46 to the spring arms 40 and 42.

Continued pressure on the indicating member 18 causes the spring arms 40 and 42 to flex in a direction away from the skirts 48 and 50, allowing the detent teeth 44 and 46 to slip over the edge of the skirts 48 and 50, at which time the bias of the spring arms 40 and 42 reposition the spring arms 40 and 42 and position the detent teeth 44 and 46 within the interior of the skirts 48 and 50, locking the indicating member 18 in the non-indicating position. It is, of course, realized that if one of the openings 52 or 54 is located in a position wherein the detent teeth 44 and 46 should strike the skirts 48 and 50, the detent teeth 44 and 46 will simply pass through their appropriate openings 52 and 54 until the detent tooth 44 or 46 is located within the interior of the skirt 48 or 50.

The device functions as follows. The user of the device 10 moves the indicating member 18 from the indicating to the non-indicating position by simply using finger pressure to depress the indicating member 18 towards the slot 16. As noted above, when the indicating member 18 is almost into the non-indicating position, the detent teeth 44 and 46 contact the skirts 48 and 50 and are moved because of their bevels such that the spring arms 40 and 42 give, allowing for positioning of the detent teeth 44 and 46 within the interiors of the skirts 48 and 50. Once these detent teeth 44 and 46 are positioned within the interior of the appropriate skirts 48 and 50, the indicating member 18 is locked into the non-indicating position and the spring 38 is tensed such that when the grip between the detent teeth 44 and 46 and the skirts 48 and 50 are released the spring 38 will once again move the indicating member 18 to the indicating position. After placing the indicating member 18 into the non-indicating position, the user of the device 10 simply grips the device 10 and rolls it along a surface such that the wheels 20 and 22 are in contact with the surface and rotate because of movement of the device 10 along the surface. As was noted above, the effective outside diameter of the wheeels 20 and 22 are different, such that if the device 10 is moved in a straight line, the wheels 20 and 22 will rotate at a different rate of rotation because of their different circumferences such that the openigns 52 and 54 within the skirts 48 and 50 do not rotate in conjunction with one another, but are rotated at different speeds. Further, if the user of the device 10 pivots the device, one of the wheels 20 or 22 will remain stationary while the other of the wheels 20 or 22 continues to rotate. Further, it is possible, by turning the device 10 about a vertical axis which essentially passes through the device 10, that one of the wheels 20 or 22 could rotate in a clockwise direction wherein the other of the wheels 20 or 22 would rotate in a counterclockwise direction. All of the above described motions serve only to move the openings 52 and 54 in the skirts 48 and 50 at different speeds and directions in relationship to one another.

When one of the openings 52 or 54 is directly in line with the appropriate detent tooth 44 or 46, that detent tooth 44 or 46 theoretically could pass through this opening 52 or 54. If, however, the other of the detent teeth 44 or 46 is not in line with the opening 52 or 54, it will be maintained against the inside of the skirts 48 and 50 which, in turn, will maintain in a fixed position both the spring arm 40 or 42 to which it is attached, as well as the central section 30, which, in turn, will maintain the position of the other spring arm 40 or 42 and its corresponding detent tooth 44 or 46 in a fixed position still within the interior of its appropriate skirt 48 or 50. Thus, if only one of the detent teeth 44 or 46 is appropriately located adjacent to its opening 52 or 54, it will not move through the opening because it is essentially prevented from doing so by the location of the other detent tooth 44 or 46 still within the appropriate skirt 48 or 50.

If, however, both of the detent teeth 44 and 46 become located in their respective openings 52 and 54 at exactly the same time, they will both move through the openings 52 and 54, allowing for rotation of the central section 30 about its axles 32, which in turn allows for movement of the indicating member 18 from the non-indicating position to the indicating position under the force incorporated into spring 38. Normally, when the device 10 is being moved across a surface and the openings 52 and 54 become appropriately located allowing for movement of the indicating member 18 from the non-indicating position to the indicating position, the user of the device 10 will not instantaneously stop movement of the device 10, but will continue rolling the device 10 for a small increment of movement. This is enough to cause a further rotation of the openings 52 and 54 past the position wherein they allow movement of the detent teeth 44 and 46 through them. Even though the indicating member 18 is allowed to thus move from the non-indicating position to the indicating position, the wheels 20 and 22 have been given a small further increment of rotation. Thus, when the indicating member 18 is once again pushed down from the indicating to the non-indicating position, the openings 52 and 54 have been moved slightly from the position wherein they allowed the detent teeth 44 and 46 to pass through them. Their new position will be a position wherein the detent teeth 44 and 46 will contact the skirts 48 and 50 when the indicating member 18 is depressed to the indicating position. Because of the incremental rotation produced before the device 10 is stopped, it is unlikely that the detent teeth 44 and 46 would pass through these openings and not catch against the skirts 48 and 50.

Because of the difference in the diameters of the wheels 20 and 22, and the ability of one or both of these wheels 20 and 22 to move independently in both direction and speed with respect to one another, a random alignment of the openings 52 and 54 in positions wherein they allow both of the detent teeth 44 and 46 to simultaneously pass through them is achieved. It is evident that both of the openings 52 and 54 must be appropriately aligned with the detent teeth 44 and 46 before the indicating member 18 will move from the non-indicating position to the indicating position. If only one of these openings 52 or 54 is aligned, the misalignment of the other of the openings 52 or 54 will essentially maintain the indicating member 18 in the non-indicating position.

While I have shown an illustrative embodiment of my invention, it will be understood that my invention utilizes certain principles and concepts which are not limited to only the illustrated embodiment, but which are capable of other expressions. For this reason, my invention is to be construed in light of the claims appended to this specification which are directed to these principles and concepts and is not to be construed as being limited to the illustrated embodiment shown in this specification.

I claim:

1. A device for producing a random output which comprises:

a housing;

a first and second rotary member each rotatably mounted on said housing and each capable of rotating with respect to said housing independent of the other;

a continuously variable portion of each of said first and said second rotary members located in positions wherein said portions are capable of being contacted against a surface and said contact between said portions and said surface independently rotating both of said first and said second rotary member with respect to said housing in response to movement of said housing with respect to said surface;

an indicating means movably mounted on said housing, said indicating means capable of alternately being located in an indicating position and a non-indicating position, said indicating means including a moving means capable of moving said indicating means from said non-indicating position to said indicating position;

a first control means, a portion of said first control means associated with said first rotary member and the remaining portion of said first control means associated with said indicating means;

a second control means, a portion of said second control means associated with said second rotary member and the remaining portion of said second control means associated with said indicating means;

each of said first and said second control means capable of being located in either a release position or a locked position, each of said first and said second control means alternately moving between said release position and said locked position in response to rotation of said first and said second rotary members, respectively, on said housing;

said indicating means moving under the influence of said moving means from said non-indicating position to said indicating position when both of said first and said second control means are in said release position, said indicating means incapable of moving under the influence of said moving means from said non-indicating position to said indicating position when at least one of said first or said second control means is in said locked position.

2. The device of claim 1 wherein:

each of said first and said second rotary members comprises a wheel rotatably mounted on said housing and said continuously variable portion of each of said first and said second rotary members comprises the circumferential periphery of each of said wheel.

3. The device of claim 2 wherein:

one of said first and said second wheels has a radius greater than the other of said first or said second wheels.

4. The device of claim 3 wherein:

each of said first and said second wheels includes circumferentially extending axially projecting skirt means.

5. The device of claim 4 wherein:

said portion of said first control means associated with said first rotary member comprises a first release means located on said first wheel skirt means and said portion of said second control means associated with said second rotary member comprises a second release means located on said second wheel skirt means.

6. The device of claim 5 wherein:

said indicating means includes a first release arm means and a second release arm means;

said first release arm means comprising said portion of said first control means associated with said indicating means and said second release arm means comprising said portion of said second control means associated with said indicating means;

said first release arm means being operatively associated with said first wheel skirt means and said second release arm means being operatively associated with said second wheel skirt means.

7. The device of claim 6 wherein:

said indicating means includes an indicating member pivotally mounted on said housing and including said first and said second release arm means attaching to and movable with said indicating member;

said moving means comprises biasing means operatively associated with said indicating member and biasing said indicating member towards said indicating position.

8. The device of claim 7 wherein:

said first release arm means comprises a first spring arm having ends, one of said ends of said first spring arm attached to said indicating member and the other of said ends of said first spring arm including a first latching means, said first latching means operatively associated with said first wheel skirt means and said first release means;

said second release arm means comprises a second spring arm having ends, one of said ends of said second spring arm attached to said indicating member and the other of said ends of said second spring arm including a second latching means, said second latching means operatively associated with said second wheel skirt means and said second release means;

when one of said first or said second latching means is associated with its respective first or second wheel skirt means said one of said first or said second latching means maintaining said indicating member in said non-indicating position and when both of said first or said second latching means are associated with their respective first or second release means said indicating member capable of moving under the influence of said biasing means from said non-indicating position to said indicating position.

9. The device of claim 8 wherein:

each of said first and said second release means comprising an opening located in said respective first or second skirt means.

10. The device of claim 9 wherein:

each of said first and said second latching means comprises a detent means located on said other end of said respective first or second spring arms.

* * * * *